US009428252B1

(12) United States Patent
Brown et al.

(10) Patent No.: US 9,428,252 B1
(45) Date of Patent: Aug. 30, 2016

(54) PONTOON BOAT DRIVEN BY PWC

(71) Applicants: Larry Brown, Ardmore, OK (US); Danielle Brown, Ardmore, OK (US)

(72) Inventors: Larry Brown, Ardmore, OK (US); Danielle Brown, Ardmore, OK (US)

( * ) Notice: Subject to any disclaimer, the term of this patent is extended or adjusted under 35 U.S.C. 154(b) by 0 days.

(21) Appl. No.: 14/300,230

(22) Filed: Jun. 9, 2014

Related U.S. Application Data

(60) Provisional application No. 61/832,226, filed on Jun. 7, 2013.

(51) Int. Cl.

| | |
|---|---|
| ***B63B 35/70*** | (2006.01) |
| ***B63B 21/62*** | (2006.01) |
| ***B63B 59/02*** | (2006.01) |
| ***B63B 35/66*** | (2006.01) |
| ***B63B 1/12*** | (2006.01) |

(52) U.S. Cl.
CPC ..... *B63B 21/62* (2013.01); *B63B 1/121* (2013.01); *B63B 35/66* (2013.01); *B63B 59/02* (2013.01)

(58) Field of Classification Search
CPC ..... B63B 35/70
USPC ..... 114/248
See application file for complete search history.

(56) References Cited

U.S. PATENT DOCUMENTS

| | | | | |
|---|---|---|---|---|
| 3,659,546 | A * | 5/1972 | Miklos | B63B 35/70 114/246 |
| 4,727,820 | A * | 3/1988 | Klaus | B63B 35/44 114/263 |
| 5,184,564 | A * | 2/1993 | Robbins | B63B 35/731 114/345 |
| 5,255,625 | A * | 10/1993 | Hattori | B63B 35/665 114/248 |
| 5,388,544 | A * | 2/1995 | Kobayashi | B63B 27/24 114/248 |
| 5,443,028 | A * | 8/1995 | Keen | B63B 35/73 114/248 |
| 5,746,150 | A * | 5/1998 | Beaulac | B63B 35/665 114/248 |
| 5,775,250 | A * | 7/1998 | Kobayashi | B63B 35/70 114/258 |
| 6,035,796 | A * | 3/2000 | Vowels | B63B 35/665 114/248 |
| 6,135,047 | A * | 10/2000 | Miller | B63B 29/04 114/248 |
| 6,595,812 | B1 * | 7/2003 | Haney | B60F 3/0015 114/360 |
| 6,840,188 | B1 * | 1/2005 | Witbeck | B63B 27/36 114/258 |
| 7,182,033 | B1 * | 2/2007 | Phillips | B63B 35/665 114/248 |
| 7,185,599 | B1 * | 3/2007 | Griffiths | B63B 35/665 114/248 |
| D556,668 | S | 12/2007 | Quinn | |
| 7,832,348 | B2 | 11/2010 | Newcomb | |
| 8,678,868 | B2 * | 3/2014 | Bailey | B63B 35/74 114/248 |
| 2007/0283869 | A1 * | 12/2007 | Quinn | B63B 1/121 114/248 |

* cited by examiner

*Primary Examiner* — Lars A Olson
*Assistant Examiner* — Jovon Hayes
(74) *Attorney, Agent, or Firm* — Harvey Law, P.C.; Derrick W. Harvey

(57) ABSTRACT

The present invention relates to a pontoon boats that may couple and be driven by a PWC. The invention further relates to pontoon boats having a portion that moves into an open water recess at the rear of the pontoon boat. The invention further relates to an engagement assembly for securing a PWC to such a pontoon boat.

17 Claims, 14 Drawing Sheets

PONTOON BOAT DRIVEN BY PWC

BACKGROUND OF THE INVENTION

1. Field of the Invention

The present invention relates to a pontoon boats that may couple and be driven by a PWC. The invention further relates to pontoon boats having a portion that moves into an open water recess at the rear of the pontoon boat. The invention further relates to an engagement assembly for securing a PWC to such a pontoon boat.

2. Description of Related Art

Pontoon boats are generally flat watercraft rely on pontoons, or air cylinders, to for buoyancy. A standard recreational pontoon boats will be of a rectangular shape and have twin lengthwise hulls or pontoons along the longer sides of the boat. Pontoon boats traditionally are equipped with an outboard engine to power its travel across and within water. They are less costly to purchase and maintain than performance boats but are useful and popular for carrying larger groups of passengers.

The idea to drive a pontoon boat with a smaller craft is addressed in the arts to varying effects and purposes. In some instances, a personal watercraft (PWC) has been described to steer a larger boat or watercraft. U.S. Pat. No. 5,746,150 describes a boat with a docking bay with U-shaped channels to receive a bumper of a PWC. Other examples, such as depicted in U.S. Pat. No. 5,255,625 involve a boat with a floor upon which a PWC would substantially moor while driving the larger boat. In other examples found in the art such as U.S. Pat. No. 7,832,348, fixed restraints are deployed to harness the PWC to a boat.

For reasons of cost, maintenance and storage, users of recreational watercraft prefer to own PWC over larger watercraft. When those users travel to water recreation destination such as lakes, they may wish to rent pontoon boats in situ in order to transport groups of people across the lake, but still travel with and utilize their own PWC. PWC have at two standard sizes dictated by the size of its engine, either two-stroke or four-stroke. The larger four-stroke engine is the more prevalent in the current PWC market, but many two-stroke engine PWCs are still utilized in the manner described above. With different sizes can change the dynamics of docking and storing the PWC within the bay of the pontoon boat. Even within the categories of two stroke and four stroke PWCs, there is some variation as to the footprint and profile of the PWCs manufactured over time.

As the above references describe, docking a PWC into the bay of a pontoon boat has a host of challenges. Less understood in the arts is the concept that driving a larger boat with a PWC presents its own set of challenges in water flow dynamics and navigation. Specifically, obstructing the water flow around the engine of the PWC can reduce the power, responsiveness, and overall navigability of the PWC. Mooring the PWC partially or completely upon a plate creates challenges with cavitation. Past solutions in the arts do not provide an easy mechanism for connection or release so that users or operators with little training may safely decouple and use a PWC from the pontoon boat while out on the lake. In sum, the market remains woefully undeveloped and unsatisfied with the solutions offered to dock any PWC to a pontoon boat.

Consequently, there remains a need in the arts of coupling a PWC to a pontoon boat that is safe and relatively simple. There remains further a need for such a pontoon boat to engage a PWC of different sizes. There remains even further a need for the pontoon boat to receive and secure a PWC that allows the PWC to navigate the pontoon boat. With many existing pontoon boats in current use, there is a need to retro-fit such existing boats with an assembly to engage a PWC. Finally, there remains a need to provide a trailer that may carry such a combination pontoon boat and PWC that offers an ease of loading directly into a body of water.

Accordingly, a general objective is to provide a novel pontoon boat for capably and safely receiving a PWC to use the power of the PWC to propel the pontoon boat. Another objective is to provide an assembly for coupling the pontoon boat and PWC that is novel in its approach, simple in use, and more secure than past attempts in the arts. Yet another objective is that the coupling of the PWC to the pontoon boat allows the PWC to propel and navigate in the water without interference by structures under the hull of the PWC. Another objective is to couple any available PWC to a pontoon boat so that its engine, ingrate, impeller, and steering nozzle are positioned appropriately in the water. PWC Finally, an objective is to provide a trailer that offers an ease of loading and unloading for carrying the novel pontoon boat and the PWC.

Other objectives and advantages of this invention will become apparent in the following summary and detailed descriptions.

SUMMARY OF THE INVENTION

These and other objects were met with the present invention, which relates in a first embodiment:

A pontoon boat capable of engaging to and then retracting from a PWC with the pontoon boat, the PWC then being used to navigate the pontoon boat comprising:

A) a front end and a rear end,

B) an open bay at a rear end of the pontoon, the bay having a first bay side,

C) the first bay side having a securing portion, capable of moving towards the PWC that is positioned at least partially in the open bay, D) an engagement mechanism that may compel the securing portion of the boat to move from an unengaged position to an engaged position in contact with the PWC, E) a release that allows the securing portion to retract to an unengaged position.

These objectives were met in a second embodiment:

A method for coupling onto and retracting from a PWC within a pontoon boat for the purposes of operating the boat using the PWC, the method comprising:

A) Driving the PWC into an open water recess of the pontoon boat into a coupling position with the boat, B) Moving the boat towards the PWC until the PWC is generally immobilized, C) Holding the PWC at least partially within the pontoon boat in the open water at its natural operating profile, D) Navigating the boat using the PWC, E) Retracting the boat from the PWC.

These objectives were met in a third embodiment:

A) An engagement assembly kit to convert an existing pontoon boat into one that may engage with and be driven by a PWC, the kit comprising:

B) a first deck and a second deck, the first deck and second deck to affix to the rear of an existing pontoon boat at the outer part of the pontoon boat so that an open bay is formed between the first deck and second deck, C) at least one deck comprising a securing portion capable of moving towards the open bay, D) an engagement mechanism that compels the securing portion of the boat to move from an unengaged position to an engaged position in contact with the PWC, E) a release that retracts the securing portion of the boat from an engaged position to an unengaged position.

BRIEF DESCRIPTION OF THE DRAWINGS

The invention will now be described in greater detail with reference to the drawings, wherein.

DETAILED DESCRIPTION OF THE INVENTION

Pontoon boats have been fashioned to receive PWCs for the purposes of using the PWC as the propulsion and navigation of the PWC. The two primary challenges with the concept of coupling a pontoon boat with a PWC involve: 1) docking and securing the PWC to the pontoon boat in a simple, safe manner, and 2) operating the pontoon boat using the full capabilities of the PWC.

The present invention addresses these challenges in a manner that is absent in the arts. The present invention provides an assembly that mechanically joins the traditional pontoon boat PWC having variable sizes (including 2 cycle or 4 cycle engine). The invention also solves the problem of correctly positioning a PWC in water so that its propulsion system operates intended. The invention further provides an assembly that moves a securing portion from the edge of the bay onto a docking PWC and engages the PWC at its bumper rail. The invention provides a solution of automatic engagement that utilizes pressurized air existing in the pontoons to power movement of one of its deck towards the PWC. The invention provides system for coupling between a PWC and pontoon boat that enables the PWC drive the larger craft without disrupting the water flow dynamics of the PWC. The invention additionally provides a manual engagement for securing/disengaging the PWC from the pontoon boat that the driver may utilize and deploy without leaving the seat of the PWC. The invention provides that the manual engagement and disengagement of the PWC may take place in the water, so that the PWC may be utilized for fun while the pontoon boat is anchored or docked. The invention provides a solution for driving a pontoon boat by using the full, unobstructed power and navigational potential of the PWC.

Figure 1:
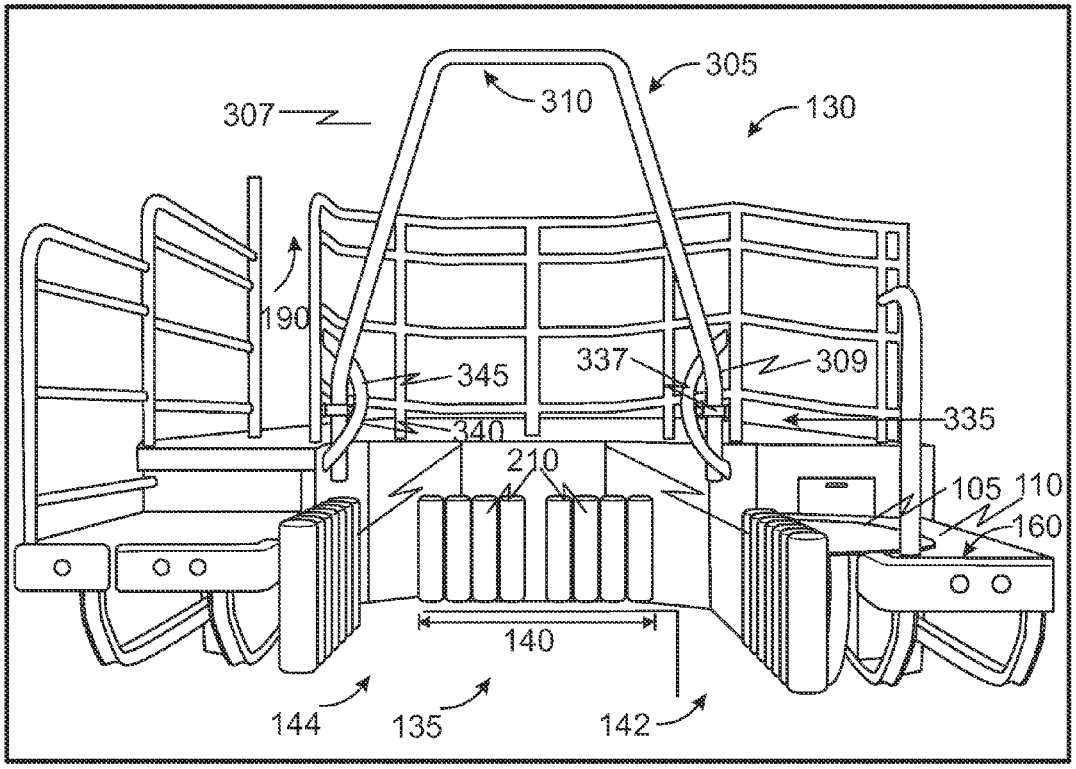
FIG. 1 is a rear view of an embodiment of pontoon boat.
Figure 2A:
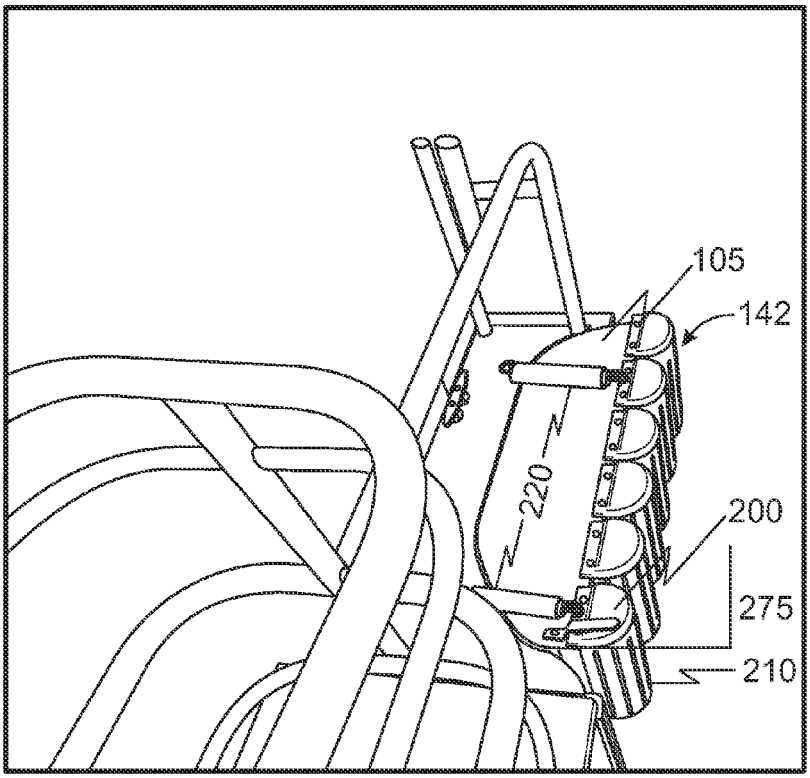
FIG. 2*a* is a top view perspective of the rear section of the first bay side of the inventive pontoon boat.
Figure 2B:
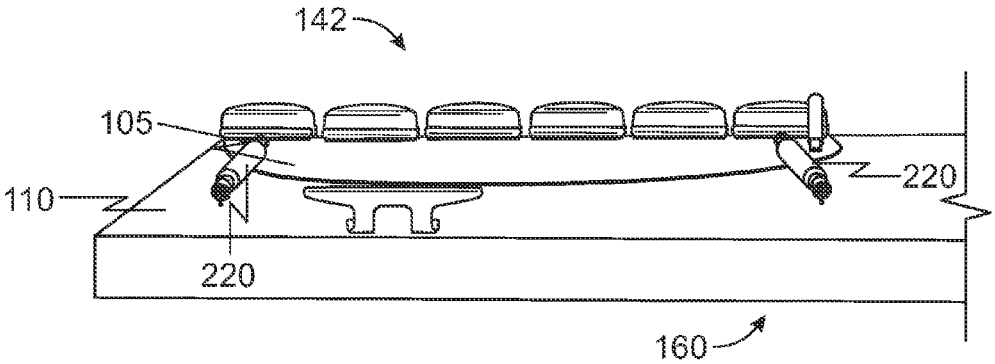
FIG. 2*b* is side view of the outer perimeter of the pontoon boat at the first bay side.

Looking to an embodiment shown in FIGS. 1-2, a pontoon boat 130 is disclosed with an open bay 135 to receive and engage a PWC 120 for the purpose of powering and navigating the pontoon boat with the PWC 120. The pontoon boat 130 may be pre-formed with the open bay 135 at its stern, having a first bay side 142 and a second bay side 144 that may define the entrance of the PWC 120 into the bay 135 from the rear of the boat. The first bay side 142 and second bay side 144 may have surfaces, or decks, that generally correlate to or reside above with a first pontoon tank 150 and a second pontoon tanks 150. The open bay 135 may be unobstructed by other structures so that a PWC 120 encounters only the body of water upon which the boat 130 and PWC 120 rest. In other embodiments of the invention, the first bay side 142 and second bay side 144 may include structures other than the decks shown in FIGS. 1-7.

Figure 8:
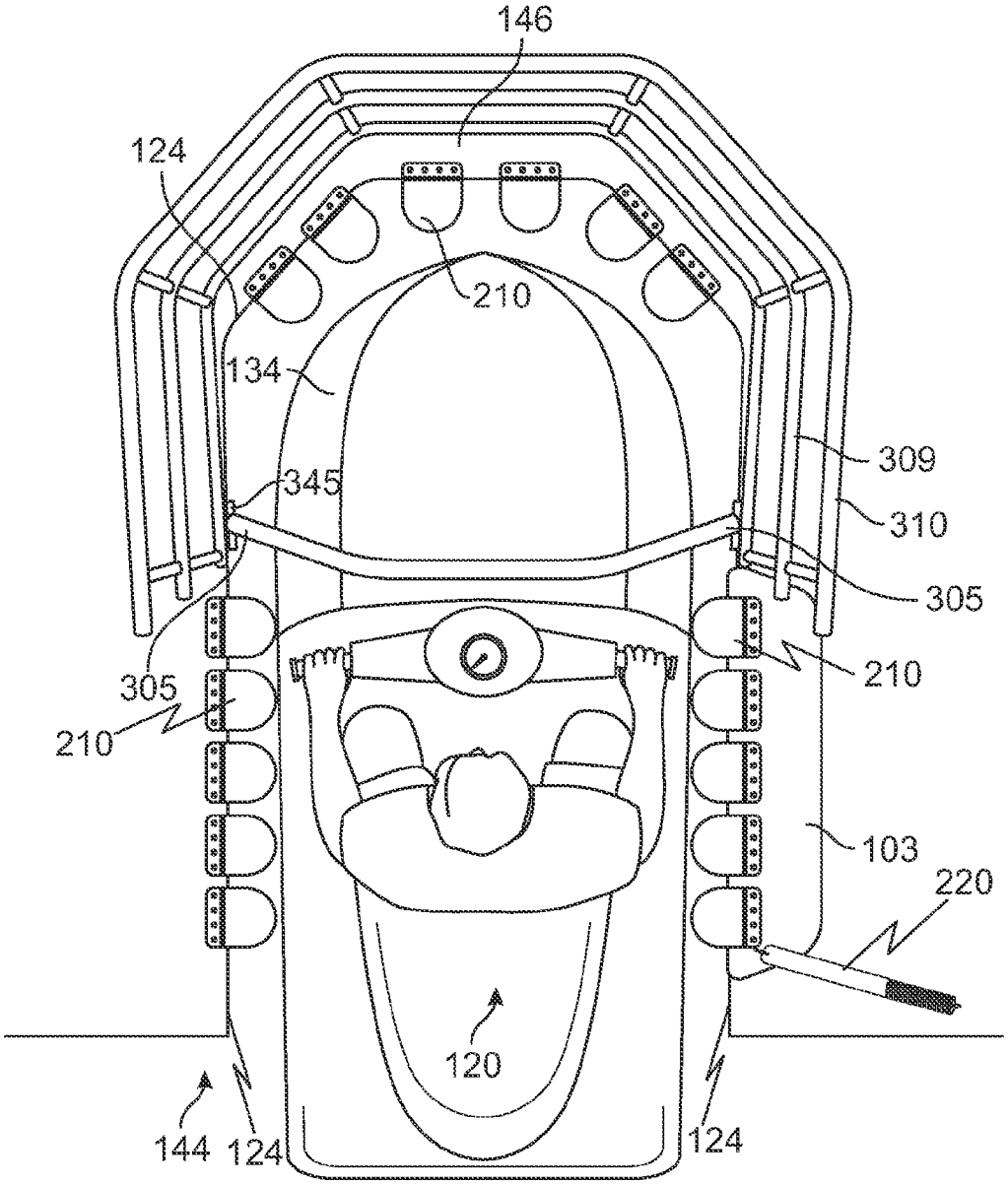
FIG. 8 is a top plan view of the open bay at the rear of the pontoon boat as it is in engaged position with the PWC.
Figure 9:
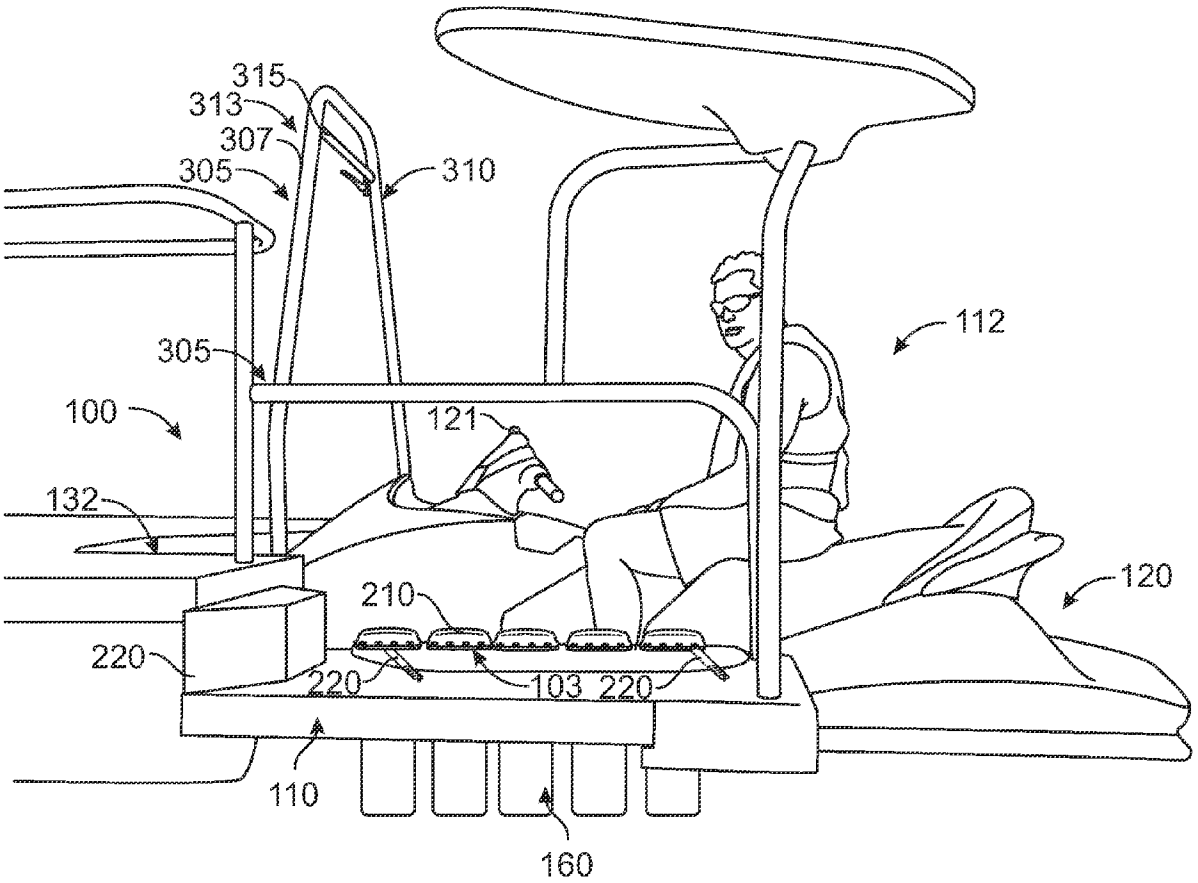
FIG. 9 is a side perspective view of an operator of the PWC in a coupling position in the open bay of the boat.

As seen in FIGS. 1, 2, and 9, the open bay 135 may transition towards the front of the boat 130 with a passenger portion 190 that may extend up to the remainder of the boat's length. Different embodiments of the passenger portion 190 of the pontoon boat 130 may vary in structural footprint, multiple vertical tiers or upper "stories," length, and width from that shown in FIG. 1. As illustrated, the passenger portion 190 may include guard rails about its perimeter that generally prevent passenger mobility into the open bay 135 area. The deck at the second side 144 may be used as a swim deck or loading area for the PWC 120 with or without a guard rail or gate. As shown in FIGS. 1 and 8, the open bay 135 may resemble half of a regular decagon. The first side 142 and second side 142 may comprise portions of the bay that are right and left of the midline of the of the pontoon boat 130, in either order. According to other embodiments, the relationship of the open bay 135 with its first and second sides 142, 144 may vary, and include both linear and/or curved aspects.

The pontoon tanks 150 may be filled with air or other capacity media as is well known in the art and is traditionally used to keep pontoon boats afloat. FIG. 1 discloses an embodiment of the invention where the twin pontoons tanks the boat 130 terminate at or near the decks, though other lengths of pontoons may be utilized in the scope of the invention. Pontoon tanks 150 may have cages, or a V-shaped structure that may project downward about and below the pontoons. Cages may protect the pontoon and provide a smoother hull profile for the pontoon boat 130.

The pontoon boat and engagement assemblies may be constructed of materials known in the arts for watercraft. For example, the aluminum grade 5052 was utilized for the decks, the piping, and other pontoon boat structures that are metal. Bumpers 210 may be ordinary dock bumpers such as inflatable, marine grade vinyl. Buffers may be a high-impact, UV protected plastic that provide a buffer 215 at the rear of the pontoon boat in case the PWC does not make a clean entry into the open bay area.

The open bay 135 may exist where the outboard engine would traditionally be situated between the twin pontoon tanks, at the rear or stern end of the boat. Additionally, existing pontoon boats may be retro-fitted with inventive engagement assemblies in order to engage different sizes and shapes of PWC. In embodiments not shown in illustrations, a pontoon boat may include two assemblies, one on each side deck of the bay of the pontoon boat, so that each side of a PWC may communicate with the pontoon boat via the assembly. In yet another embodiment, the pontoon boat may include more than two pontoon tanks, such as a third pontoon tank that extends from the middle of the bay 135 to the front of a tri-toon boat.

The invention may broadly include an engagement mechanism that moves a side of the deck of the pontoon boat to engage a PWC. PWCs are equipped with a rail that circumnavigates the perimeter 140 of the PWC just above its waterline. The rail is intended to act as a buffer or first line of contact with other objects that may come into contact with the PWC. In the embodiments shown in FIGS. 1, 9 and 10, the PWC is engaged at and around its rail by the bumper 210 or other structures within the bay 135 of the pontoon boat, especially at the securing portion 105, that frictionally retains the PWC 120 with sufficient stability to then use the PWC 120 to propel the pontoon boat. The perimeter 140 of the open bay 135, including at the back of the pontoon boat, may be covered with a buffer 215 from the deck portion down to below the water level, or at the base of the pontoon boat. Portions of the 140 of the base of the open bay 135 may be fitted with flexible flaps that may shield the operator of the PWC 120 from excessive water that sprays from the open bay 135.

Looking further at the stern end of the pontoon boat in FIG. 1, an engagement or assembly is deployed for use towards the stern end the pontoon boat. The assembly may comprise a securing portion of the deck 105 or other structure located at the first bay side. The securing portion 105 may extend along a length of the first bay side 142 up, and may comprise the entire length of the first bay side 142. The decks at the first bay side 142 and second bay side 144 may be lowered from the passenger portion of the boat, as shown in the FIGS. 1, 3*b* and 9.

In FIGS. 1, 2 3, 6, 7, 8 and 9, the securing portion of deck 105 and other portions of the deck along the interior perimeter 140 of the bay including the second bay side 144 may have one or more bumpers 210 that meet the side rails of PWC 120. Looking at the illustrated bumpers 210 more closely in FIG. 2*a*, six are positioned generally along the securing portion of the deck 105. In this embodiment, bumpers 210 form a barrier along the interior perimeter 140 of the open bay 135 so that the PWC 120 must encounter bumpers 210 no matter the speed or angle of entry into the bay 135. The bumpers 210 may contain air or other fluids, and in an embodiment of the invention, bumpers contain less than full amount of air that allows a slight compression of the bumpers 210 upon meeting the rail of the PWC 120. In this embodiment, bumpers 210 allow the PWC 120 to be engaged and secured at the same level as the PWC operated autonomously or before coupling with the pontoon boat, enabling the PWC to operate at its optimal altitude regardless of which the model of PWC utilized. Other embodiments of bumpers within the scope of the invention may comprise other configurations and structures of bumpers that allow communication with the rails of the PWC 120, including but limited to clamps or other enveloping structures.

Figure 3A:
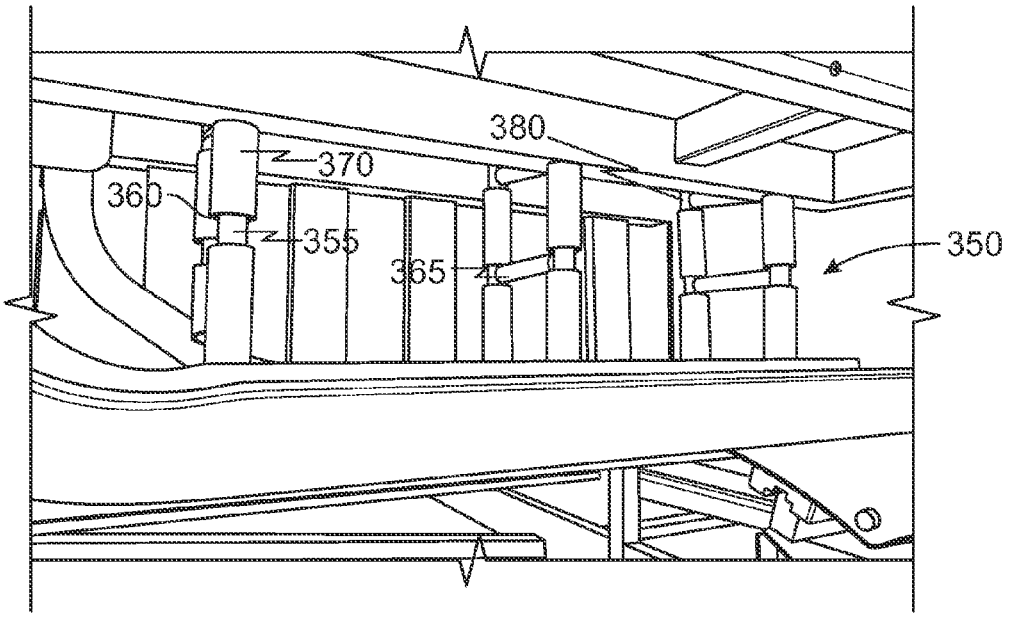
FIG. 3*a* is a side perspective view of the hinging system.
Figure 3B:
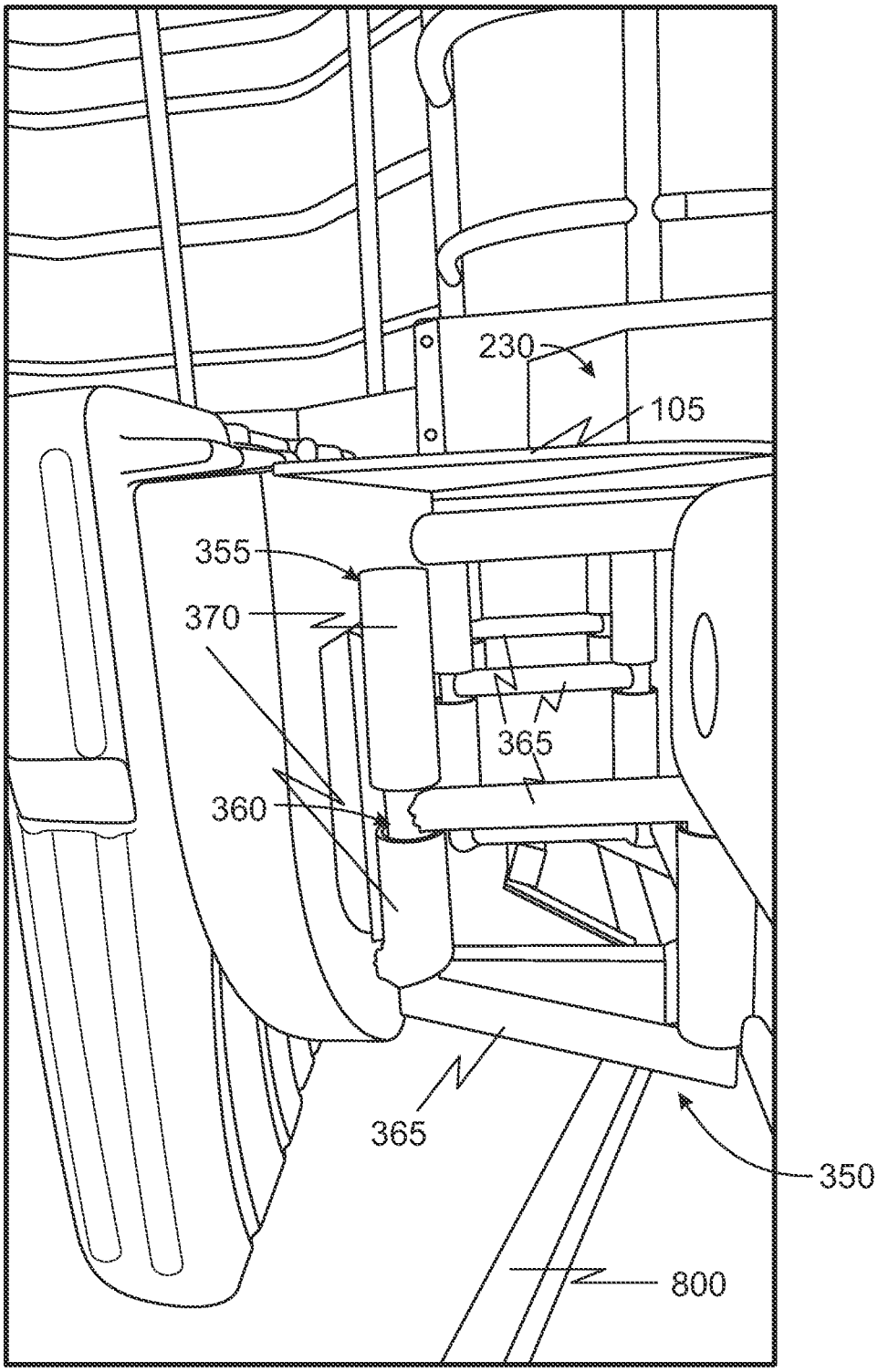
FIG. 3*b* is a rear elevational view of the hinging system of the boat.
Figure 4A:
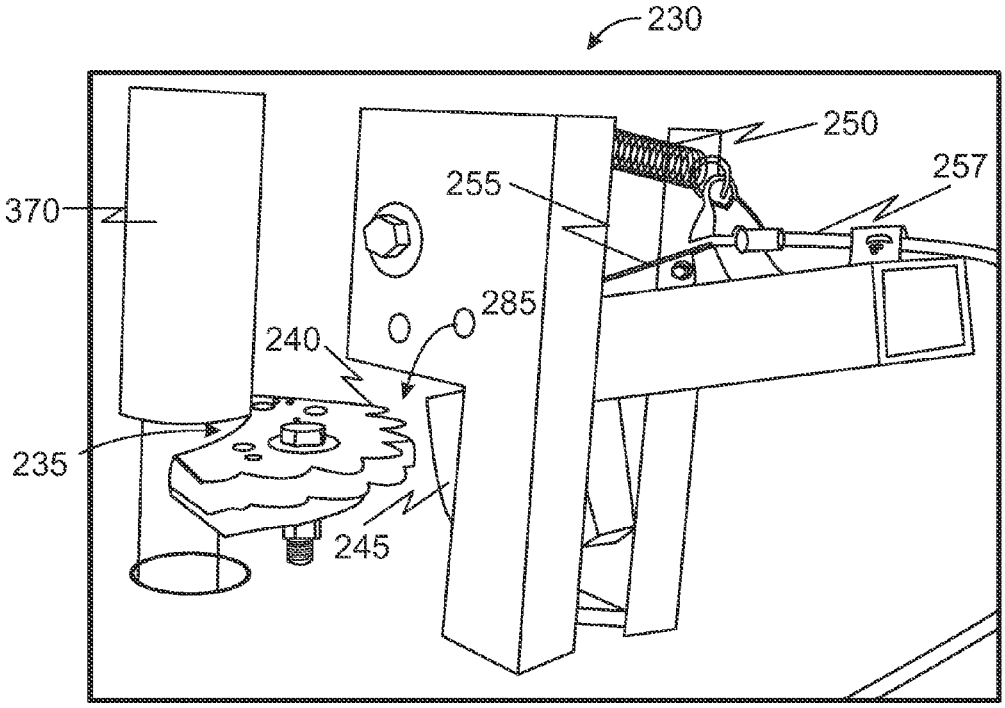
FIG. 4*a* is a top perspective view of the cog gear system in the unengaged position.
Figure 4B:
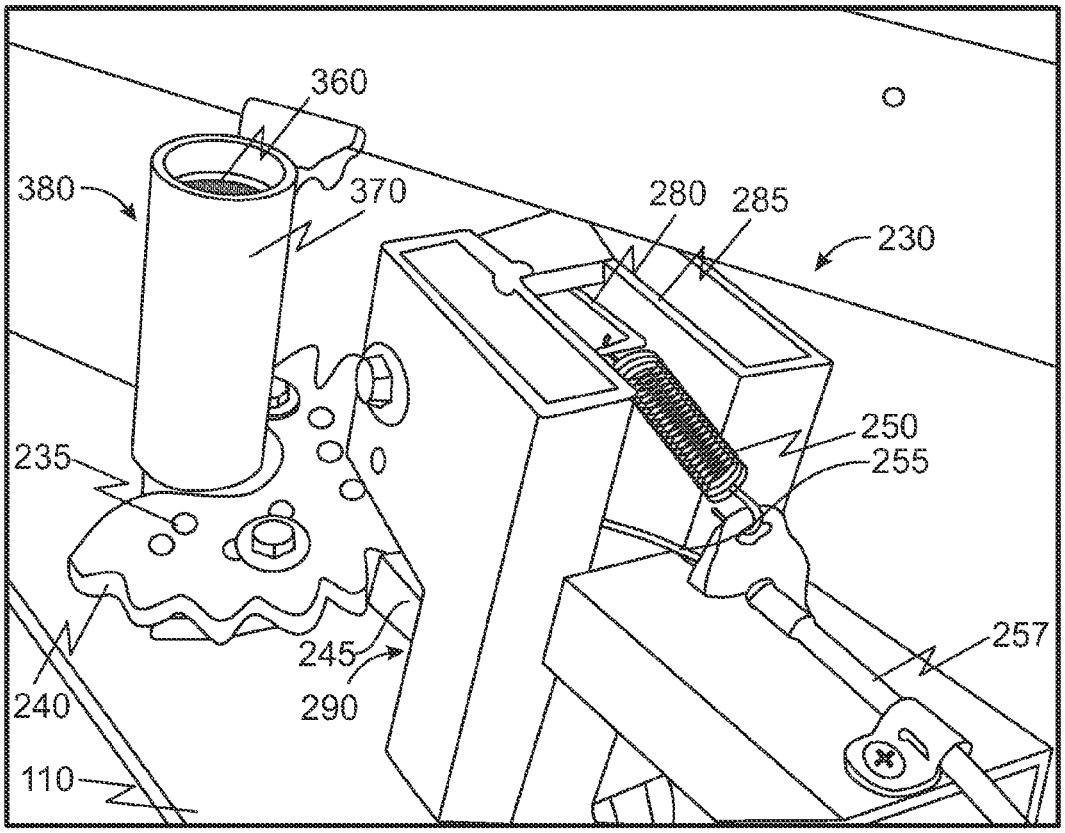
FIG. 4*b* is a top perspective view of the cog gear system in the engaged position.
Figure 5:
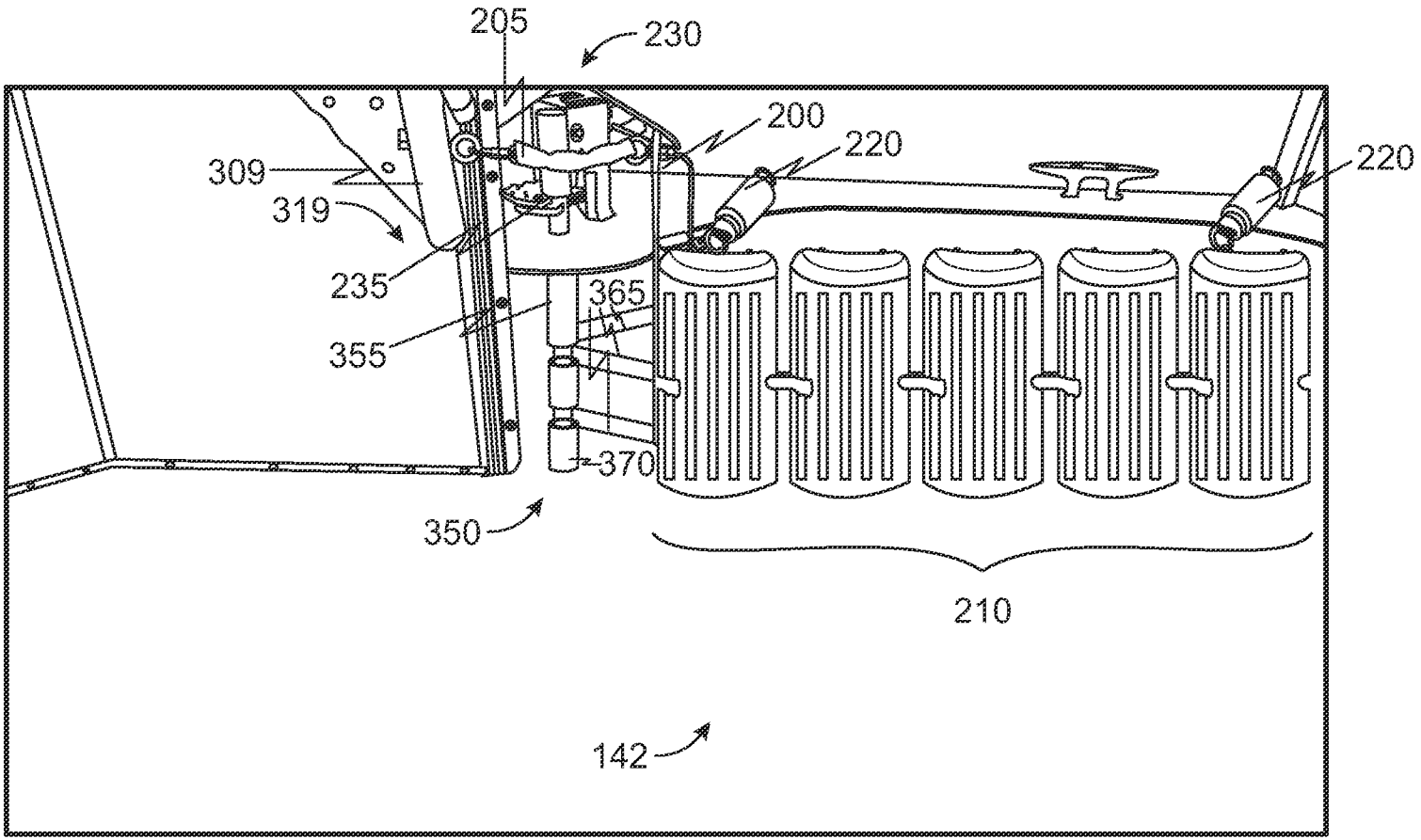
FIG. 5 is an interior side view of the first bay side of the boat.

The securing portion 105 of the first bay side 142 may be attached, directly and/or indirectly, to a fixed portion 110 of the pontoon boat 135. FIGS. 3*a* and *b* show securing portion 105 extending towards the open bay 135 from a fixed portion of the deck 110 by means of a hinging system 350. In the embodiment shown in FIG. 3, hinging system 350 may comprise an "E" style hinge having a first vertical element 355 at the securing portion 105 and a second vertical element 355 at the fixed portion of the deck 110 of the pontoon boat. Hinging system 350 may further comprise three lateral elements 365, connecting the first vertical element 355 and the second vertical element 355. The lateral elements 365 hold the first vertical element 355 at a distance from the second vertical element 355 and provide stability during the movement of the securing portion of the deck 105 from the fixed portion of the deck 110. First vertical elements 355 and second vertical elements 355 are depicted as having sheaths 370 partially cover vertical elements 355 between the lateral elements 365. In FIG. 3, bushings 360 may be positioned between the shafts 330 and vertical elements 355.

Figure 7A:
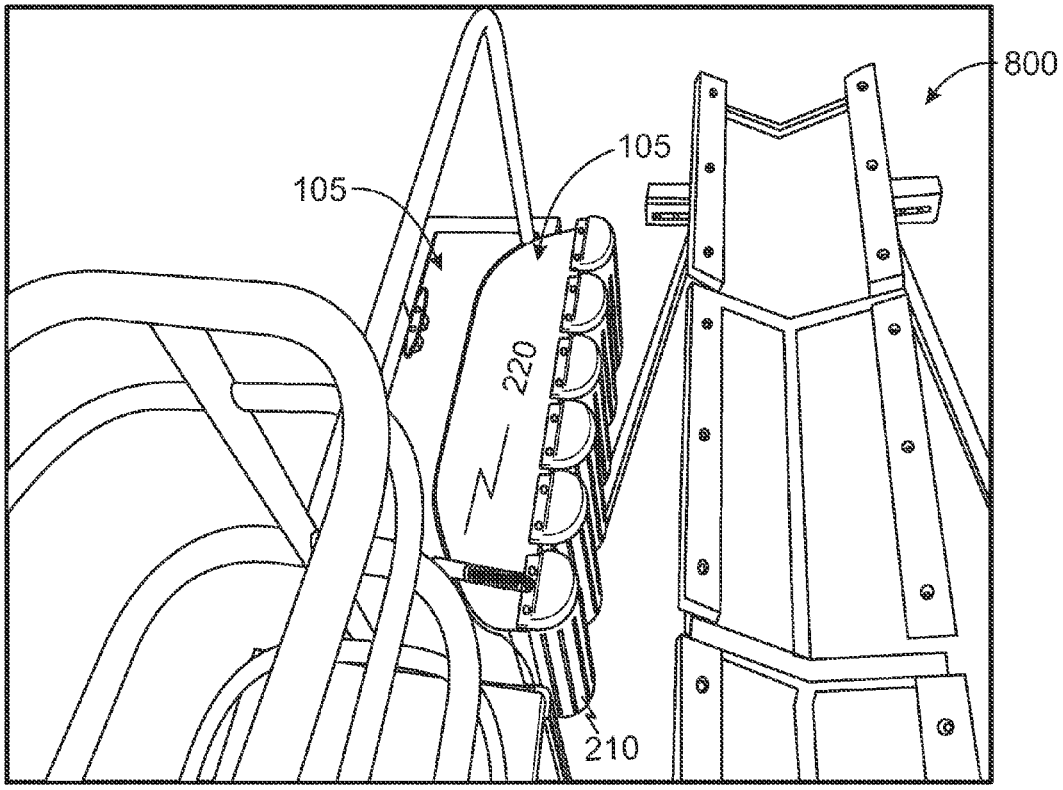
FIG. 7*a* is a top perspective view of the first bay side of the boat as it sits on a trailer.
Figure 7B:
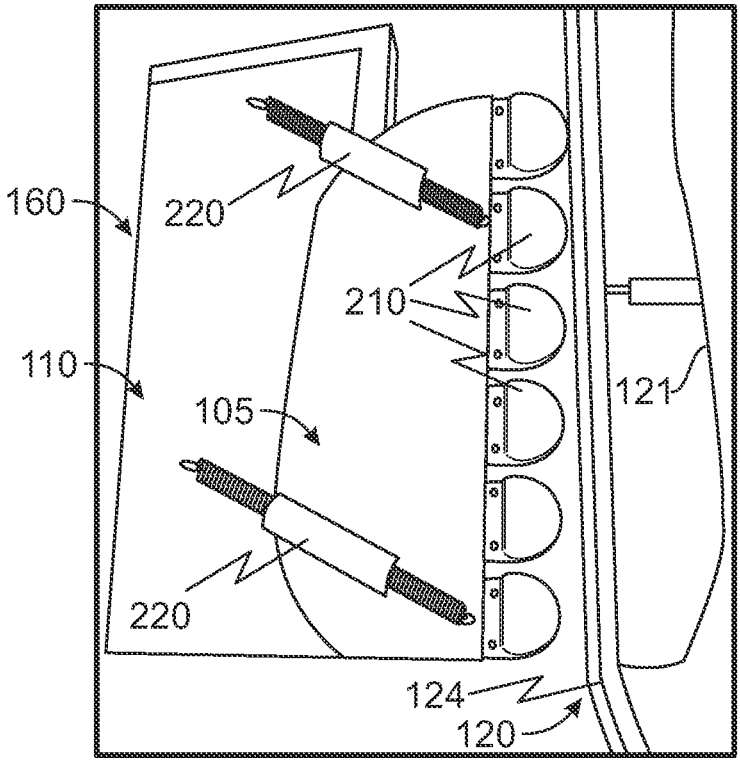
FIG. 7*b* is a top perspective view of the first bay side of the boat with the securing portion in an engaged position with the PWC.

In the embodiment shown in FIGS. 2*a* and 7, securing portion 105 may travel an arcuate path relative to the fixed portion 110, the path progressing towards a midline of the open bay 135 until securing portion 105 contacts the PWC 120 in an engaged position 270. The arcuate path of the securing portion 105 may be enabled with the hinging system. As the securing portion 105 moves from the unengaged position 275 to the engaged position 270, first vertical elements 355 may experience a circular movement around the second vertical elements 355 connected by the corresponding lateral elements 365. The circular movement may provide a rotation to the second vertical elements 355 within the sheaths 370. The amount of rotation of the rotation of the second vertical elements 355 may correlate to the distance traveled from the unengaged position 275 of the securing portion 105 to its engaged position 270.

Though hinging system 350 is positioned under the deck in FIG. 3, it may be located above the deck or in other areas of the pontoon boat in other embodiments within the scope of the invention. Hinging system may comprise other hinges known in the arts to convey one object away from another object. In other embodiments, hinging system may be replaced with other connections or mechanisms that allow conveyance of one part of the pontoon boat towards a PWC 120 within a recess of the PWC 120.

In FIG. 4, a second vertical element 355 most proximal to the cog gear system 230, or the axis 380, may extend from below the fixed portion to above the fixed portion, or therethrough the deck. Bushings may be positioned between axis and the sheaths. Sheaths may attach to the pontoon boat so that axis may rotate independently of sheaths. Axis may be a vertical element, as described herein and depicted in FIG. 4, or resemble other structures or forms that convey rotation. As the axis rotates, it imparts a rotation to a cog gear.

Cog gear system is shown in FIG. 4 to comprise a gear having two or more cogs and a lock that engages at a locked status, but may still advance through the cogs. Lock may hold a rotational position as axis turns, so that lock maintains the cog position advanced through the rotation of the cog gear system. In FIG. 4, lock may be released to an unlocked status. Lock lever may include the lock at a first end, and connects to a lock spring at a second end. The spring pulls the second end, biasing the first end and lock towards the cog gear and into the spaces between the cogs. When the lock release is engaged, the lock retracts from the cog gear at the first end of the lever. In FIG. 4, a line travels over the lock lever and attaches at the first end of the lever. Line is partially shielded by line cover from the point where the lock spring attaches to outline the cog gear assembly to a lock release. In operation, the cog gear system may enable the securing portion 105 to engage the PWC 120 and hold an engaged position 270 as the PWC 120 propels the pontoon boat.

The securing portion 105 may be further attached to the fixed portion 110 of the pontoon boat with one or more tension elements. Looking at FIGS. 1, 2, 5, 6, 7, 8 and 9, tension elements are represented by two springs that attach the securing portion 105 to the fixed portion 110 of the pontoon boat 130, connecting at eyelets above the securing portion 105 and fixed portion 110, respectively. Additional springs are within the scope of the invention. In other embodiments, springs may connect the securing portion 105 to other areas of the pontoon boat 130, or to the fixed portion 110 under the deck. When the securing portion 105 of the pontoon boat 130 is in an engaged portion against the PWC 120, the springs also extend out to an engaged position 270 and hold a tension that is held when the cog gear is in a locked status.

The pontoon boat and its engagement assembly may further comprise an arm that communicates a force, directly or indirectly, to move the securing portion 105 from an unengaged position 275 to an engaged position 270 that securely engages the PWC 120. In FIG. 8, the arm spans from the second side of the bay 135 to the first side of the bay 135. In a first position, the arm extends vertically from the decks of the pontoon boat proximal to the open bay 135, past the rails of the pontoon boat to overhead of the operator 122 (of average height) of the PWC 120, or a generally vertical profile. As seen in the embodiment shown in FIGS. 1, 6, 8 and 9, arm may comprise grasping element and a displacing element. Grasping elements may comprise lateral extensions at different altitudes toward the top of the arm, thereby enabling the operator 122 to pull the arm in a downward, arcuate motion. Grasping elements as illustrated in FIGS. 1, 8, and 9 in the first position are generally positioned overhead yet within reach of the operator 122.

The second position of the arm may resemble more of a lateral profile, with the grasping element now positioned closer to the PWC 120. Once the operator 122 pulls the arm into the second position, the cog gear advances until the secured portion 105 of the first bay side 142 engages the PWC 120 on both the first bay side 142 and the second bay side 144, with the lock holding the progress as each cog passes. When the PWC 120 is fully engaged by the first bay side 142 and second bay side 144, the operator 122 may release or reset the arm back to the first position 310. As shown in the invention embodied in FIG. 8, resetting the arm 305 into the first position 310 does not move the assembly into an unengaged position 275, but merely moves the arm 305 back overhead of the operator for convenience. An arm spring 345 may extend between the arm 305 and the pontoon boat 130, allowing tension to pull the arm 305 back to the first position 310 regardless of the status of whether the arm is locked or not. In an embodiment shown in this FIG. 6, engagement arm 305 will retract back to first position 310 when the operator on the PWC 120 lets go of the grasping portion 307, in effect keeping the engagement arm 305 clear of the operator.

Figure 6:
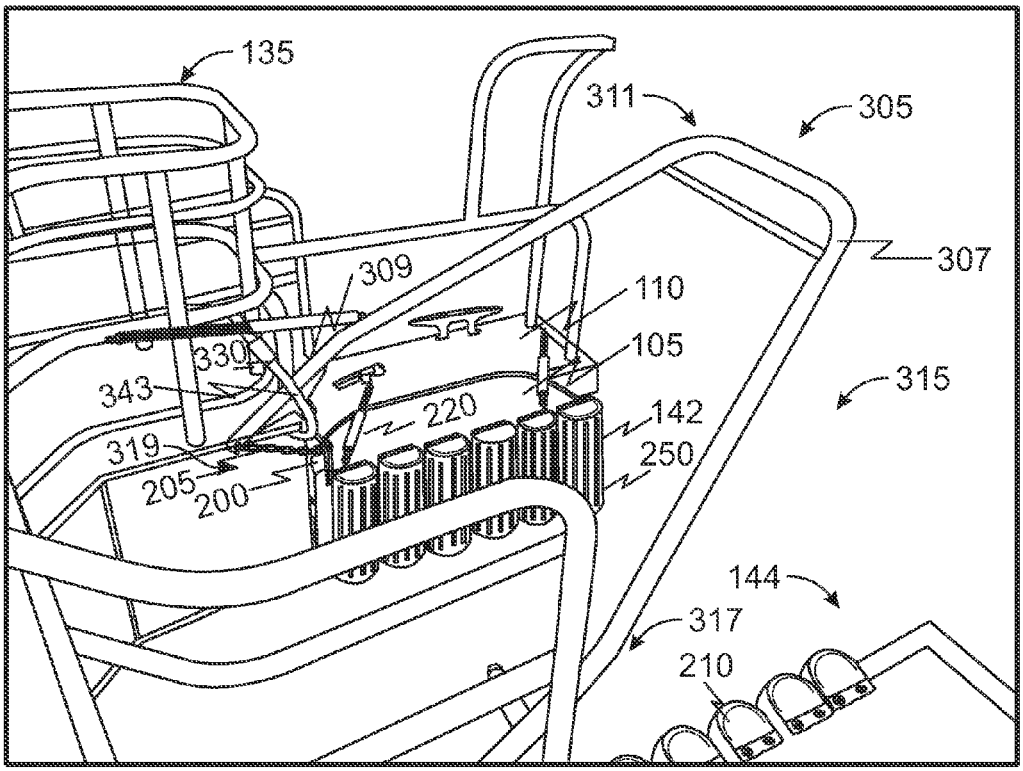
FIG. 6 is a top perspective view of the first bay side of the boat with the arm in second position.

The lock release 313, positioned on a grasping element 307 in FIG. 1, embodied in FIG. 6 as a release lever 315, may comprise a line 255 that connects to the cog gear system 230 by cable or other line known in the arts. In this embodiment seen in FIGS. 4*a*, 4*b* and 6, the line 255 connects to lock lever 280 and may be retracted by the lock release 313. When the operator 122 pulls the arm 305 back into the second position 311, the operator may manually pull the release lever 315 on the grasping element 307, thereby moving the lock 245 of the cog gear system 230 from a locked status 280 to an unlocked status 265.

Though the lever is shown as being attached to the grasping element, the release lever and grasping element may be positioned, together or separately, in other loci within reach of the operator of the PWC 120 for engagement and disengagement. For instance, the lock spring of the cog gear system may communicate with a release lever that may be engaged directly by the operator of the PWC 120, facing towards the outer edge of the pontoon boat or, with a wheel pulley, engaged directly and facing the interior perimeter 140 of the bay 135.

As the cog gear 235 rotates back and resets to its unengaged position 275, the deck springs 220, holding a tension in an engaged position 270, pull the securing portion 105 back towards the fixed portion 110 of the pontoon boat, thereby allowing the cog gear 235 to rotate back or reset to its unengaged position 275. The lock release 313 may comprise other embodiments not illustrated, including other mechanical solutions, proximity sensors or electronic means of releasing the lock remotely or by the operator 122. By example and not limitation, the operator may have the engagement mechanism 305 near the controls of the PWC 120 or around his or her neck or wrist.

Figure 10:
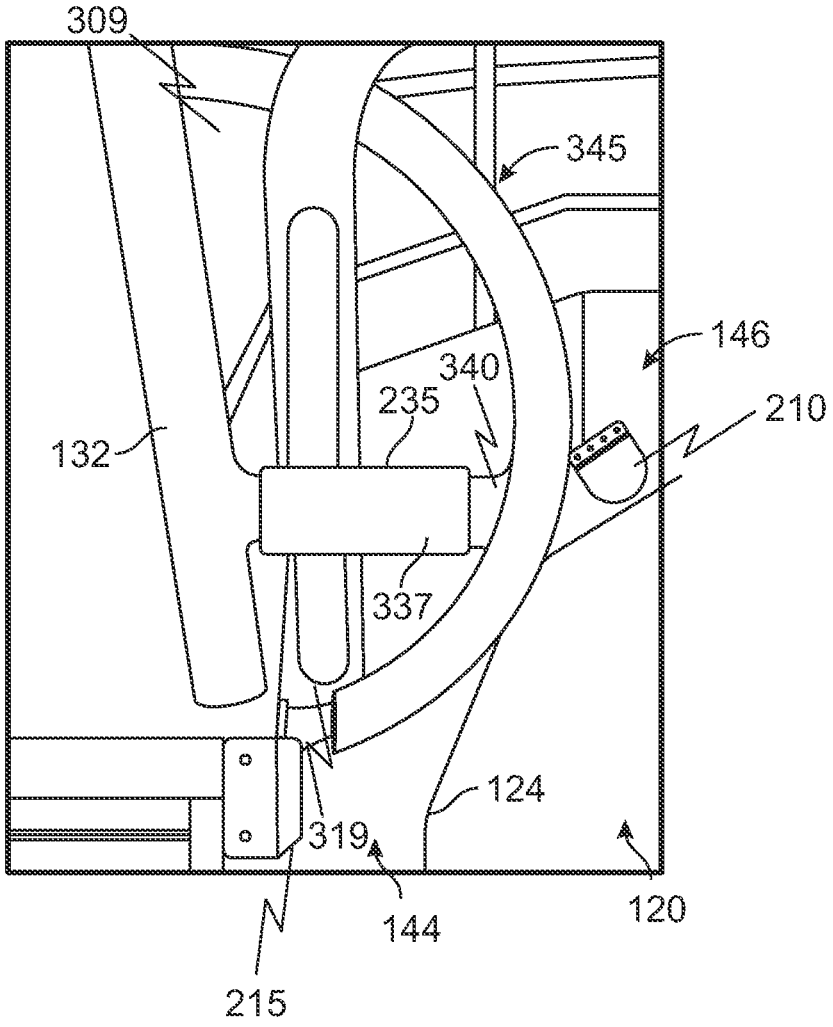
FIG. 10 is a rear view of the pivot element at the second side of the open bay.

Looking further at the embodiment in FIGS. 6 and 10, arm 305 may further comprise a displacing element 309 at the first bay side 142 and a displacing element 309 at a second bay side 144, the displacing elements 309 having a top 317 and a base 319. According to the embodiment in FIGS. 6 and 10 at an area correlating with the first side 142 of the open bay 135, the displacing element 309 comprises a pivot element 335 that extends perpendicular to both sides of the displacing element 309. The pivot element 335 provides the arm 305 with a point about which the arm may pivot in its progression or advancement from the first position to the second position. In FIGS. 6 and 10, the pivot element 335 is open on both ends, and includes a pivot shaft 337 that may receive a rod of smaller diameter. The pivot shaft 337 may be lined with a bushing 360 that surrounds a fixed element having a concentric relationship with the pivot shaft 337. Attached to the interior perimeter 140 of the pontoon, the fixed element 340 may journal through the pivot shaft 337, emerge, and then intersect with an arm stabilizer 343 that extends in a generally vertical plane at points below and above the pivot shaft 337. The arm stabilizer 343 may connect to the pontoon boat below the pivot shaft 337 to the stern side 170 of the displacing element 309, and to the bow side 180 of the pontoon boat above the pivot shaft 330. When the operator 122 wishes to disengage the PWC 120 from the pontoon boat, the operator pulls the release lever 315 and releases the cog gear 235 to its unlocked status 265; the arm 305 retracts back to its first position 305 generally overhead of the operator, compelled by the tension in the arm spring 250.

In an embodiment of the invention, the arm stabilizer may define a range within which the arm may travel back and forth from its first position to its second position.

Looking further the base of the vertical shaft of the arm 305 in FIGS. 6, 9 and 10, the arm 305 may connect to a hitch 200 of the secured portion of the deck 105, or below where the arm stabilizer 343 connects to the pontoon boat within the open bay 135. The hitch 200 may have a height above the deck or top surface of the secured portion 105 so that the arm 305 may pull the secured portion 105 along its arcuate path towards the front of the boat until the secured portion 105 reaches the engaged position 270. A hitch chain 205 may extend between the hitch 200 and arm 305.

In operation, the inventive pontoon boat enables an operator 122 of a PWC 120 to quickly engage and propel the pontoon boat without a great deal of training or mechanical manipulation. The operator 122 assumes the helm at the PWC 120, drives into the open bay 135 or recess at the rear of the PWC 120. Because the interior perimeter 140 of the open bay 135 is provided with bumpers 210 and buffers 215, the only contact between the pontoon boat and PWC 120 will be between the bumpers 210 and the side rails of the PWC 120, limiting the potential damage or injury to the vessels and operators as the PWC 120 enters or departs the coupling position 125 in the open bay 135. When the operator 122 maneuvers the PWC 120 so that it is at the back of the open bay 135, the operator pulls down the grasping portion 307 of the engagement arm 305 from a first position 310 to a second position 311. The engagement arm 305 communicates a motion that pulls forward the securing portion 105 of the deck, which follows an arcuate path towards the PWC 120 in the coupling position 125. The hinging system 350 converts the forward motion of the securing portion 105 into a rotation of the axis 380 that turns a cog gear 235, allowing the lock 245 to slip into the space between each cog 240 as the rotation of the cog gear 235 progresses. When the securing portion 105 of the deck contacts the PWC 120 side of the PWC 120 and moves it into the second bay side 144, the bumpers 210 will press into the side rail of the PWC 120 until sufficient resistance is met to hold the PWC 120 in a stable, generally immobile status vis a vis the pontoon boat. The engagement arm 305 may be released back into the first position 310. Because the distance between the unengaged position 275 and engaged position 270 is not fixed, PWCs of variable size may be used without additional maintenance or set up. The cog lock 245 holds the PWC 120 at the first 142 and second 144 bay sides of the pontoon boat so that the operator 122 may propel the pontoon boat using the PWC 120. If the operator wishes to board the pontoon boat, the stable, immobile state of the PWC 120 vis a vis the boat prevents rocking or tipping as the operator steps from the PWC 120 to the deck of the pontoon boat. When the pontoon boat is in a preferred position to anchor, for instance a lake cove that is desirable for swimming by the other occupants of the pontoon boat, the operator of the PWC 120 may disengage from the pontoon boat in the following manner. The operator 122 may pull the engagement arm 305 back down to the second position 311 and engage the release lever 315 on the grasping portion 307, unlocking cog gear 235, allowing the securing portion 105 to retract back to its unengaged position 275 and freeing the PWC 120 from the pontoon boat and allowing the PWC 120 to be used for recreational purposes while the pontoon boat is anchored in a desired area of the body of water. This entire process of engaging and retracting the PWC 120 from the pontoon boat may be controlled by the operator 122 at the seat of the PWC 120.

In another embodiment of the invention illustrated in FIG. 7*a*, the inventive pontoon boat may be equipped with a trailer 800 capable of transporting the PWC 120. The portion of the trailer that carries the pontoon boat may be fairly reflective of other trailers known in the arts to transport pontoon boats. A PWC portion of the trailer 800 may resemble a V-shape or other structures that have concave profiles, the perimeter 140 of the PWC portion have one or more buffers 215 that meet the PWC. The PWC portion may further include support members extend to the first bay side and second bay side of the portion of the trailer 800 that carries the pontoon boat 130. In FIG. 7*a*, the trailer 800 includes a stand for the PWC to ride in a position that is approximately that of the coupling position when the PWC is in open water. In fact, the engagement mechanism may be deployed so that the securing portion 105 squeezes the PWC on the trailer as it would in the water. Setting the engagement mechanism into an engaged position would have a benefit of stabilizing the PWC and pontoon boat on the trailer during travel on the roadways.

Figure 11:
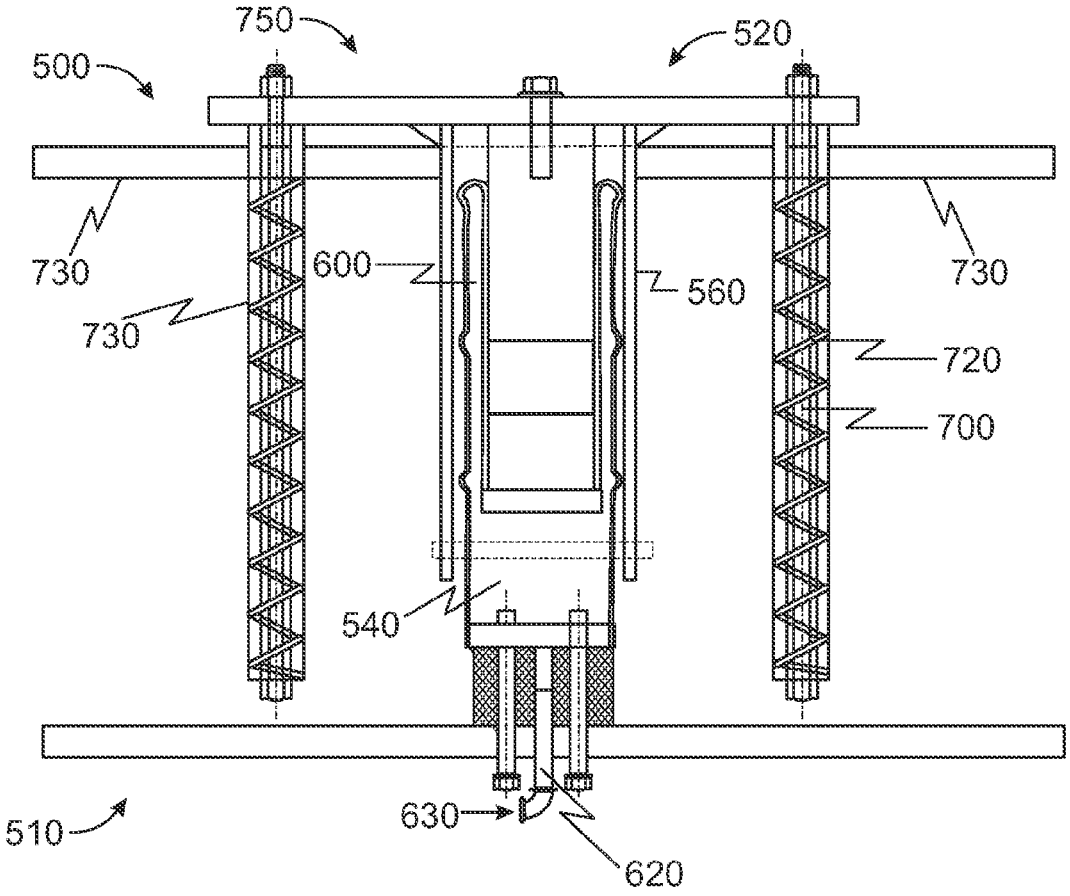
FIG. 11 is a top view of an embodiment of the engagement mechanism.

In another embodiment of the invention shown in FIG. 11, the engagement assembly 100 may comprise a first mount end 500 and a second mount end 510, the first mount end 500 may be located generally proximal to the bay 135 of the pontoon boat and the second mount end 510 located distal of the bay 135 of the pontoon boat, or towards the outer edge of the pontoon boat. The assembly 100 may comprise an extending mount 520 at the first mounting end 500. The extending mount 520 may comprise a plate or mounting apparatus that comprises a length in a parallel plane as a swim decks and pontoon tanks at the rear of the pontoon boat. The extending mount 520 may be disposed outside the swim decks and into the open bay area. The extending mount may support a number of structures that move along with the mount towards the middle of the bay 135 and engage with the PWC 120, and thus away from the swim decks.

In an embodiment of the invention, the assembly 100 comprises a cylinder 540 having axial length oriented from the first mount end 500 to a second mount end 510. Guide tubes 560 may be secured at the extending mount 520 and may further comprise a cap 570 at its opposite end. The guide tube 560 may have an axial length from the extending mount 520 towards a second mount end 510, the guide tubes 560 at least partially encasing the cylinder 540.

An inflating bladder 600 may be disposed between the guide tube 560 and the cylinder 540, the bladder 600 communicating with a conduit 620 through which inflating media 630 such as air may be introduced into the bladder 600. The conduit 620 may lead to a fitting for interfacing with the inflating media 630.

In a preferred embodiment, the inflating media 630 is air provided by the pontoon tanks of the pontoon boat. However, other media may be implemented, such as water or other visco fluid media.

Looking further at FIG. 11, an extending member 530 may be secured at the extending mount 520, the extending member 530 positioned within the guide tube 560. The extending member 530 is positioned to be capable of traveling axially within the cylinder 540 and the guide tube 560. The bladder 600 may communicate with the extending member 530 in the following manner: As inflating media 630 is introduced into the bladder 600, the bladder inflates from the second mount end 510 towards the first mount end 500, forcing the extending member 530 and thus the extending mount 520 to move distal of the second mount end 510.

An extension rod 700 secured to the extending mount 520 and positioned in an axial path toward the second mount end 510, the extension rod 700 journaling through compression springs 720 within a spring tube 730. A spring stop 740 may be disposed at the first mounting end 500, the spring stop 740 preventing the compression springs 720 from traveling along with the extension rod 700 as the extending mount 520 moves distal of the second mount end 510 during operation of the assembly 100. As extending mount 520 moves away from the second mount end 510, the springs 720 compress along the extension rod 700 and hold an extension tension. This tension serves to counterbalance the force of the bladder 600 acting upon the extending member 530 in the guide tube 560. As a result, the extending mount 520 is held in a uniquely secure position through the opposing axial forces described above.

Portions of embodiment shown in FIG. 11 may be formed with stainless steel, including but not limited to the compression springs and the extending rod, The assembly 100 may comprise a coupling portion 125 to engage a PWC 120, the coupling portion secured to the mounting end opposite that of the extending rod. The coupling portion 125 according to preferred embodiments may comprise one or more clamps that directly or indirectly engage the PWC 120, and specifically above and below the rails of the PWC 120. In an embodiment of the invention, clamps may be disposed with different lengths from the extending mount so that the clamps may attach to portions of the PWC 120 that are of varying distance from the extending mount. The clamps may be positioned in various angles with regard to each other to properly address the tendency of some PWC 120 to have an angular profile below the rail of the PWC 120.

In another embodiment of the invention, the coupling portion 125 may comprise an arcuate aspect. The arcuate aspect may have a concave or convex profile. The arcuate aspect may include a deep point between a top and bottom portions. As a PWC 120 enters into the bay 135 of the pontoon boat, the deep point may correlate to the rail of the PWC 120 that run longitudinally along the side of the PWC 120 and extend out to the widest point of the bumpers 210 of the PWC 120. The arcuate aspect may communicate with the one or more clamps of the assembly 100 so that as the clamps move toward the PWC 120, the arcuate aspect engages the bumper of the PWC 120. In preferred embodiments, one or more clamps apply pressure above and below the bumper though indirectly through the arcuate aspect.

An embodiment of the invention found in FIG. 11 details a pontoon boat for use with the inventive assembly 100. The boat may comprise a first pontoon tank and a second pontoon tank. The first pontoon tank and second pontoon tank may correlate to a first bay defining element and a second bay defining element located at an aft end of the pontoon boat, or where the outboard engine is traditionally located. In an embodiment of the invention, the first bay defining element and second bay defining element may be swim decks that may be lowered from a cabin deck of the pontoon boat. Together the first and second bay defining elements may define a bay 135 of the boat at its aft end.

In yet another embodiment of the inventive pontoon boat, the bay 135 comprises an aft end where the PWC 120 enters the pontoon boat bay 135 and a docking end where a front of the docked PWC 120 after coupling to the pontoon boat. In this embodiment, the aft end may have a greater distance between the first bay defining element and the second bay defining element at its aft end that it does at its docking end.

In another embodiment of the invention, an assembly kit is provided to retrofit an existing pontoon boat, one generally known in the arts. The kit may be used to convert the existing pontoon boat into one that may engage with and be driven by a PWC 120. The kit may comprise a first deck and a second deck which may affix to the rear of an existing pontoon boat so that an open bay 135 is formed between the first deck and second deck. Generally, the open bay 135 will correlate to the area where the motor of the pontoon boat once resided.

The kit may have at least one deck comprising a securing portion 105 capable of moving towards the open bay 135. The kit may further comprise an engagement mechanism similar to those described herein that compels the securing portion 105 of the boat to move from an unengaged position 275 to an engaged position 270 in contact with the PWC 120 and a release that retracts the securing portion 105 of the boat from an engaged position 270 to an unengaged position 275. Bumpers 210 may be added to the decks to engage the rail of the PWC 120.

While the present invention has been described in conjunction with the specific embodiments set forth above, many alternatives, modifications and other variations thereof will be apparent to those of ordinary skill in the art. All such alternatives, modifications and variations are intended to fall within the spirit and scope of the present invention.

What is claimed is:

1. A pontoon boat capable of engaging to and then retracting from a PWC with the pontoon boat, the PWC then being used to navigate the pontoon boat comprising:

a front end and a rear end, an open bay at a rear end of the pontoon, the bay having a first deck, the first deck having a securing portion of the first deck, capable of moving towards the PWC that is positioned at least partially in the open bay, an engagement mechanism that may compel the securing portion of the first deck to move from an unengaged position to an engaged position in contact with the PWC, a release that allows the securing portion to retract to an unengaged position.

2. The pontoon boat in claim 1, the engagement mechanism comprising An arm having a grasping element within reach by an operator on the PWC, the arm capable of an advancement from a first position to a second position as the grasping element is pulled by the operator on the PWC, whereby the advancement of the arm compels the securing portion to move from the unengaged position to the engaged position, a cog gear assembly comprising a gear having cogs and a lock that engages between the cogs of the gear to hold the engaged position, the gear capable of rotating from a locked position to an unlocked position, the lock capable of releasing from the locked status to the unlocked status, a hinge system at the first deck, the hinge system extending between the securing portion and a fixed portion of the pontoon boat, the hinge system facilitating movement of the securing portion away from the fixed portion of the pontoon boat to the PWC, the hinge system communicating a rotation to the axis.

3. The engagement mechanism of claim 2, the hinge system further comprising a first vertical element of the securing portion and a second vertical element of the fixed portion, the first vertical element traveling an arcuate path about the first vertical element as the securing portion moves from an unengaged to an engaged position.

4. The hinge system of claim 3 having a plurality of second vertical elements and a plurality of first vertical elements, one of the second vertical elements being the axis.

5. The pontoon boat of claim 2, the arm further comprising:

a pivot element comprising a fixed element and a pivot shaft, the fixed element on a first end having an attachment to the pontoon boat and on a second end having perpendicular relationship with the arm, the pivot shaft having an attachment with the arm and being capable of rotating about the fixed element, a portion of the arm above the pivot element and a portion of the arm below the pivot element, the portion of the arm below the pivot element having an attachment to the securing portion, the first position having a general vertical profile with the grasping element generally overhead of the operator on the PWC, the second position having a generally lateral profile, whereby the portion of the arm above the pivot element travels an arcuate path about the pivot element and the portion of the arm below the pivot element travels an opposing arcuate path away from the securing portion, an arm spring extending between the arm and the pontoon boat, the arm spring retracting the arm to the first position when the operator lets go of the grasping element of the arm.

6. The grasping element of claim 5 further comprising a release lever to release the lock to unlocked status.

7. The engagement mechanism of claim 2 further comprising at least one deck spring extending between the securing portion and the fixed portion, the deck spring stretching as the securing portion moves to an engaged position, whereby upon release of the engagement mechanism the spring contracts the securing portion back into the unengaged position.

8. The pontoon boat in claim 1, the engagement mechanism and release being controllable by an operator on the PWC, whereby the operator may, without leaving the PWC, maneuver the PWC at least partially into the open bay and activate the engagement mechanism of the pontoon boat to engage the PWC, drive the pontoon boat to a point of interest, activate the release to disengage the PWC, and exit the open bay in the PWC.

9. The pontoon boat in claim 1 further comprising:

a second bay side having a deck, the second bay side located across the open bay from the first deck, a back bay side that joins the first deck and second bay side, the back bay side correlating to a front nose of a PWC in a engaged position, a passenger portion located closer to the front end of the boat than the deck and securing portion, the deck and securing portion being lower than the passenger portion of the pontoon boat wherein an operator of the boat may step across from the PWC to the deck, at least one bumper at the first deck, the second bay side, and the back bay side.

10. The fixed portion of claim 7 being partially covered by the securing portion and positioned towards an outer perimeter of the pontoon boat.

11. The pontoon boat of claim 1 further comprising: a first mount end and a second mount end, the engagement mechanism further comprising:

An extending mount at the first mounting end, an air spring cylinder having axial length oriented from the first mount end to a second mount end, a guide tube secured at the extending mount, the guide tube having an axial length toward a second mount end, the guide tube at least partially encasing the air spring cylinder, a bladder disposed between the guide tube and the air spring cylinder, the bladder communicating with a conduit through which inflating media may be introduced into the bladder, advancing the bladder towards the first mount end An extending member secured at the extending mount, the extending member positioned within the guide tube, the extending member capable of traveling axially within the air spring cylinder, thereby moving the extending mount.

12. The pontoon boat in claim 9, the release discharging the bladder and retracting the securing portion back to the unengaged position.

13. A trailer for transporting the pontoon boat in claim 1, trailer, the trailer having a pontoon boat portion and a PWC portion, the PWC portion located generally at the open bay, whereby when the pontoon boat and PWC are on the trailer, the engagement mechanism may be activated, moving the securing portion to the engaged position with the PWC.

14. The pontoon boat in claim 1 further comprising a passenger portion located to the front of the first deck and second deck, the first deck and second deck being lower than the passenger portion of the pontoon boat.

15. An engagement assembly kit to convert an existing pontoon boat into one that may engage with and be driven by a PWC, the kit comprising:

a first deck and a second deck, the first deck and second deck to affix to the rear of an existing pontoon boat at the outer part of the pontoon boat so that an open bay is formed between the first deck and second deck, at least one deck comprising a securing portion capable of moving towards the open bay, an engagement mechanism that compels the securing portion of the boat to move from an unengaged position to an engaged position in contact with the PWC, a release that retracts the securing portion of the boat from an engaged position to an unengaged position.

16. The kit in claim 15, the engagement mechanism and release being controllable by an operator on the PWC, whereby the operator may, without leaving the PWC, maneuver the PWC at least partially into the open bay and activate the engagement mechanism of the pontoon boat to engage the PWC, drive the pontoon boat to a point of interest, activate the release to disengage the PWC, and exit the open bay in the PWC.

17. The kit in claim 15 further comprising a passenger portion located to the front of the first deck and second deck, the first deck and second deck being lower than the passenger portion of the pontoon boat.

* * * * *